US005746433A

United States Patent [19]

Klassen et al.

[11] Patent Number: 5,746,433

[45] Date of Patent: May 5, 1998

[54] METHOD OF PLAYING A CARDS AND DICE GAME TO DEVELOP PUBLIC SPEAKING ABILITY

[76] Inventors: Karen Klassen, 405, 720-15 Ave SW.; Dwayne Klassen, 706, 720-15 Ave SW., both of Calgary, Canada, T2R 0R6

[21] Appl. No.: 798,357

[22] Filed: Feb. 10, 1997

[51] Int. Cl.[6] ..... A63F 1/00

[52] U.S. Cl. ..... 273/302; 273/429; 273/446; 273/459; 434/185

[58] Field of Search ..... 273/236, 243, 273/299, 302, 308, 429–432, 459; 434/185

[56] References Cited

U.S. PATENT DOCUMENTS

| | | | |
|---|---|---|---|
| 3,779,557 | 12/1973 | Kritzberg et al. | 273/272 |
| 3,891,209 | 6/1975 | Kritzberg | 273/459 |
| 3,940,863 | 3/1976 | Kritzberg | 35/22 R |
| 4,216,594 | 8/1980 | Farley et al. | 273/243 |
| 4,637,799 | 1/1987 | Bouchal | 434/236 |
| 4,684,135 | 8/1987 | Bouchal | 273/269 |
| 4,927,147 | 5/1990 | Delzib | 273/146 |
| 5,100,154 | 3/1992 | Mullins | 273/429 |
| 5,257,939 | 11/1993 | Robinson et al. | 434/129 |
| 5,435,726 | 7/1995 | Taylor | 434/128 |

*Primary Examiner*—Benjamin H. Layno
*Attorney, Agent, or Firm*—David S. Thompson

[57] ABSTRACT

A cards and dice game to develop public speaking ability is disclosed. The game provides a single die which is rolled to determine the order of play. Timing and grammar judges are selected. The players take turns as speaker in sequence. Each player begins each turn by selecting a card from a stack of cards, wherein each card has a plurality of speaking topics on the card. The player then rolls the die to determine which speaking topic on the card is to be used. The player receives 1 point for every second of speech. A maximum speaking time of 3 minutes and 180 points is allowed. Points are deducted by the grammarian for speech fillers such as "ummms" and "ahhhs", and for pauses. Ten points are lost where the speaker strays from the topic.

5 Claims, 1 Drawing Sheet

Figures 1, 2:
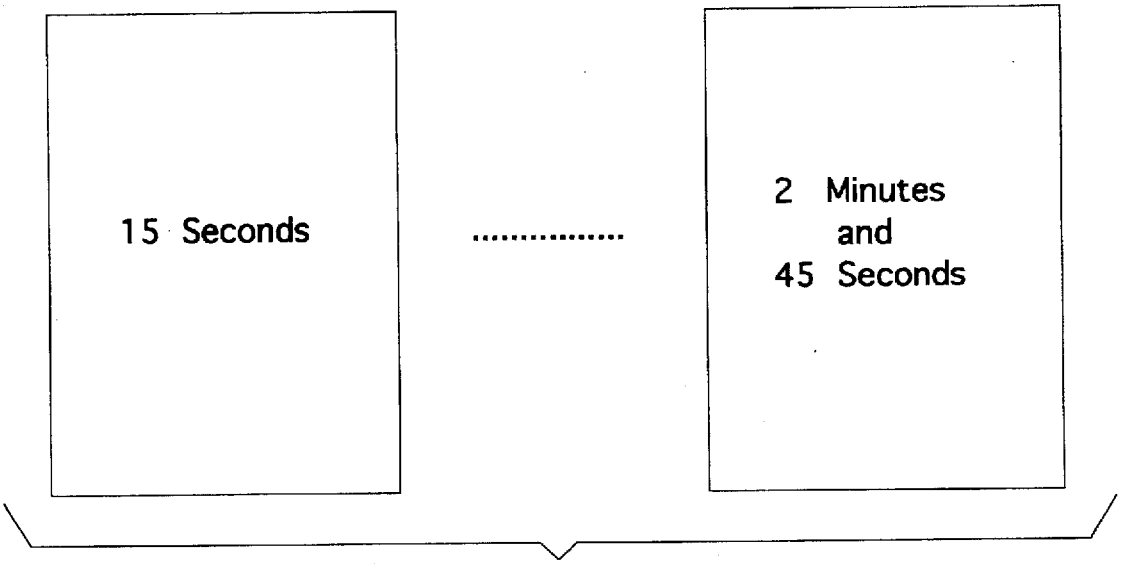

(1) What it takes to have a great Super Bowl party is...

(2) My favorite dinner grandma used to cook is ...

(3) Old movies should (should not) be "colorized", because...

(4) A memorable song lyric, and what it means to me is...

(5) If I were President/Prime Minister, a couple things I would do include...

(6) My favorite cartoon, as a kid, was ...

METHOD OF PLAYING A CARDS AND DICE GAME TO DEVELOP PUBLIC SPEAKING ABILITY

CROSS-REFERENCES

There are no applications related to this application filed in this or any foreign country.

BACKGROUND

A variety of life's endeavors require a solid public speaking ability to achieve success. Such endeavors include many fields of employment, public service and social occasions. Many people who do not have a solid public speaking ability do not enjoy the confidence which such an ability provides. As a result, many people avoid opportunities which they would otherwise pursue, are unable to open doors which would otherwise be open, and are dreadfully terrified on those rare occasions when they are required to speak publicly.

Unfortunately, the people who most need to work on their public speaking ability tend to avoid every opportunity presented. For most people, there is no safe middle ground where public speaking skills may be developed in an environment that is not threatening.

For the foregoing reasons, there is a need for a game that can teach public speaking skills to those most in need of learning such skills, and least likely to learn them.

SUMMARY

The cards and dice game to develop public speaking ability of the present invention involves the steps of:

(a) A player is chosen to play the role of the grammar judge or grammarian.

(b) A player is chosen to play the role of the timer judge.

(c) The order of play is determined in which each person within the group of people will take a turn as speaker in a sequential order. In a preferred method, the players each roll a single die to determine the order of play. The player scoring the highest score begins play as the speaker. Where two or more players roll the highest score, those players roll the die again until a single player achieves the highest score. Players take their turns in a clockwise manner from the first player.

(d) The speaker draws a card from the top of a stack of cards, wherein each card provides a plurality of speaking topics, and each topic is associated with a number, typically from 1 to 6.

(e) The speaker then rolls the die, thereby selecting which of the topics on the card drawn will be the topic of speech.

(f) The speaker then speaks on the selected topic for a period of up to, and including a maximum speech length, which in a preferred version of the invention is three minutes.

(g) In one version of the invention, the timer judge displays time cards indicating the elapsed time for which the speaker has spoken. The time cards are updated at intervals, as the elapsed time increases.

(h) The grammar judge counts the periods of silence, for purposes of scoring. In the preferred version of the invention, periods of silence are considered to be periods of four seconds or more during which the speaker is silent.

(i) The grammar judge also counts the number of speech fillers used by the speaker.

(j) The speaker's turn is then scored by the timer judge and the speaker judge, by assigning 1 point for every second that the speaker spoke up to a maximum of 180 points, and by deducting 1 point for every period of greater than four seconds during which the speaker was silent and by deducting 1 point for every speech filler used and by deducting 10 points when the other players unanimously agree that the speaker strayed off the topic.

(k) A new speaker is chosen, and steps (d) through (j) are repeated.

(l) The game, or a round of the game, is terminated when all players have been speaker.

It is therefore a primary advantage of the present invention to provide a novel cards and dice game that enables the players to become more comfortable with public speaking.

Another advantage of the present invention is to provide a novel cards and dice game that is non-intimidating and yet helps teach the art of public speaking and thinking while on one's feet that can carry over into many areas of life, including employment, public service and social affairs.

A still further advantage of the present invention is to provide a novel cards and dice game that encourages creativity and imagination, while at the same time is fun and entertaining.

DRAWINGS

These and other features, aspects, and advantages of the present invention will become better understood with regard to the following description, appended claims, and accompanying drawings where:

FIG. 1 is a view of a representative speech topics card; and

FIG. 2 a diagrammatic view of the optional timer judge's cards.

DESCRIPTION

Referring generally to FIGS. 1 and 2 and the following discussion, a cards and dice game to develop public speaking ability having playing cards, a die and rules of play consistent with the principles of the invention is seen.

To determine who will take the first turn as speaker, the players may each roll a die, with the highest scoring player to take the first turn as speaker. Ties can be broken by the tied players again rolling the die. Typically, the players will follow the first speaker in a clockwise manner.

Before play may begin, the players must choose from among themselves a person to play the role of grammar judge or "grammarian". An alternate grammarian may be selected to perform this function when the grammarian is taking a turn as speaker. The grammarian's function is three-fold. First, the grammarian must make a judgment call as to whether the speaker has stayed on the topic of speech. Secondly, the grammarian must identify and count the incidence of "speech fillers". A speech filler is a word such as an elongated "annnd", or sounds such as "ummm" or "uhhh". And thirdly, the grammarian must identify and count the incidence of periods of silence, which are defined in the preferred version of the invention as pauses by the speaker for four or more seconds without speaking.

Also before play may begin, the players must choose from among themselves a person to play the role of timekeeper. An alternate timekeeper may be selected to perform this function when the timekeeper is taking a turn as speaker. To fulfill the timekeeper's duties, the timekeeper must direct the speaker to begin speaking, and must then record the number of seconds during which the speaker spoke.

Each player, on beginning to take a turn as speaker, must first draw a card from a stack of cards, wherein each card in the stack provides a plurality of speaking topics, each speaking topic associated with a number. Typically, six speaking topics are provided on each card, one corresponding with each of the sides on a die. Referring to FIG. 2, a sample card is seen. Typically, the topics are diverse. A sample card may include such topics as: (1) What it takes to have a great Super Bowl party is . . . (2) My favorite dinner grandma used to cook is . . . (3) Old movies should (should not) be "colorized", because . . . (4) A memorable song lyric, and what it means to me is . . . (5) If I were President/Prime Minister, a couple things I would do include . . . and (6) My favorite cartoon, as a kid, was . . . .

The stack of cards is not required to be of any particular length, but must be sufficiently long that even frequent players of the game do not often encounter the same speaking topic.

After drawing a card, the player continues in the turn as speaker by rolling a die as a means of selecting one of the plurality of speaking topics on the drawn card to be the topic of speech. For example, where the number rolled on the die is a 2, the second topic on the card drawn is the selected speaking topic. All players will be told of the topic before the speaker begins to speak.

The speaker must then stand and face the other players, and at the direction of the timer judge, begin speaking on the selected topic for up to a maximum speech length, which in the preferred embodiment of the invention is 3 minutes. In one version of the invention, during the 3 minute period, the timer judge may display and update time cards indicating the elapsed time for which the speaker has spoken. For example, after 15 seconds, a card bearing the number 15 is held up, until 30 seconds have elapsed, when a card bearing the number 30 is held up. Sample time cards are seen in FIG. 3.

While the speaker is speaking, the grammarian counts and records the number of periods of silence during which the speaker does not say anything. In a preferred embodiment of the invention, a period of silence is 4 or more seconds during which the speaker is silent. Recording this number provides an incentive for the speaker to avoid pauses in an effort to extend the period of the speech.

While the speaker is speaking, the grammarian also counts the number of "speech fillers" used during the speaker's turn. Speech fillers include such words as slowly spoken words, such as "annnd . . . ", and also sounds that are not true words, such as "ummm" and "uhhh".

Following the speaker's speech, the speech is scored by assigning 1 point for every second the speaker spoke, up to and including the maximum speech length, and by deducting 1 point for every period of silence and by deducting 1 point for every speech filler used. For example, where a speaker talks for two minutes, 120 points would be awarded. However, where the total number of pauses and/or fillers was 15, then the score of 120 points would be reduced by 15 points, to equal an adjusted score of 105 points. Where the grammar judge feels that the speaker has strayed from the assigned topic, a vote of the other players is taken. If the players unanimously feel that the speaker has strayed from the subject, then an additional 10 points is deducted.

Following the scoring of the speaker's talk, a new speaker is chosen, typically by selecting the person to the previous speaker's left. The new speaker's turn follows the same procedure as the previous speaker's turn.

The game, or a round of the game, is terminated when all players have taken a turn as speaker. The winner of the round or game is the player with the most points. Alternatively, additional rounds could be cumulatively scored, thereby reducing the luck involved in the difficulty of the speaking subject.

The previously described versions of the present invention have many advantages, including a primary advantage providing a novel cards and dice game that enables the players to become more comfortable with public speaking.

Another advantage of the present invention is to provide a novel cards and dice game that is non-intimidating and yet helps teach the art of public speaking and thinking while on one's feet that can carry over into many areas of life, including employment, public service and social affairs.

A still further advantage of the present invention is to provide a novel cards and dice game that encourages creativity and imagination, while at the same time is fun and entertaining.

Although the present invention has been described in considerable detail and with reference to certain preferred versions, other versions are possible. For example, the selection of 3 minutes for the maximum speech length and 4 seconds for the period of silence are calculated to maximize the benefits of the game. However, some deviation from these periods could be made, while in still keeping with the spirit of the game. Similarly, while 1 point is awarded for each second the speaker speaks, 1 point is deducted for periods of silence and speech fillers, and 10 points are deducted for going off the assigned topic, other similar point assignment systems could be used. Therefore, the spirit and scope of the appended claims should not be limited to the description of the preferred versions disclosed.

The invention resides not in any one of these features per se, but rather in the particular combination of all of them herein disclosed and claimed and it is distinguished from the prior art in this particular method of play and type of cards used for the functions and benefits specified.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of playing a cards and dice game to develop public speaking ability, to be played by a group of people, involving the steps of:

(a) choosing a person to play the role of grammar judge;

(b) choosing a person to play the role of timer judge;

(c) determining an order of play, by which each person within the group of people will take a turn as speaker in a sequential order;

(d) drawing a card from a stack of cards, wherein each card in the stack provides a plurality of speaking topics, each speaking topic associated with a number;

(e) rolling a die as a method for selecting one of the plurality of speaking topics on the card drawn;

(f) speaking on the selected topic for up to, and including, a maximum speech length;

(g) counting periods of silence during the speaker's turn;

(h) counting the number of speech fillers used during the speaker's turn;

(i) scoring the speaker's turn by assigning 1 point for every second that the speaker spoke, up to and including the number of seconds in the maximum speech length, and by deducting 1 point for every period of silence and by deducting 1 point for every speech filler used and by deducting 10 points for straying off the topic;

(j) choosing a new speaker and repeating steps (d) through (i); and (k) terminating the game when all players have taken a turn as speaker.

2. The cards and dice game of claim 1, additionally involving the step of:

(a) displaying and updating time cards indicating the elapsed time for which the speaker has spoken.

3. The cards and dice game of claim 1, wherein the maximum speech length is 3 minutes.

4. The cards and dice game of claim 1, wherein the length of a period of silence is 4 or more seconds long.

5. A method of playing a cards and dice game to develop public speaking ability, to be played by a group of people, involving the steps of:

(a) choosing a person to play the role of grammar judge;

(b) choosing a person to play the role of timer judge;

(c) determining an order of play, by which each person within the group of people will take a turn as speaker in a sequential order;

(d) drawing a card from a stack of cards, wherein each card in the stack provides a plurality of speaking topics, each speaking topic associated with a number;

(e) rolling a die as a method for selecting one of the plurality of speaking topics on the card drawn will be the topic of speech;

(f) speaking on the selected topic for up to 3 minutes;

(g) displaying and updating time cards indicating the elapsed time for which the speaker has spoken;

(h) counting periods of silence of 4 or more seconds during the speaker's turn;

(i) counting the number of speech fillers used during the speaker's turn;

(j) scoring the speaker's turn by assigning 1 point for every second that the speaker spoke, up to and including 180 seconds, and by deducting 1 point for every period of silence and by deducting 1 point for every speech filler used and by deducting 10 points from the speaker's score where the speaker strayed off the topic;

(k) choosing a new speaker and repeating steps (d) through (j); and (l) terminating the game when all players have taken a turn as speaker.

* * * * *